US010252399B2

(12) United States Patent
Miller

(10) Patent No.: US 10,252,399 B2
(45) Date of Patent: Apr. 9, 2019

(54) ABRASIVE JET SYSTEM

(71) Applicant: Finepart Sweden AB, Bollebygd (SE)

(72) Inventor: Donald Miller, Bedford (GB)

(73) Assignee: FINEPART SWEDEN AB, Bollebygd (SE)

( * ) Notice: Subject to any disclaimer, the term of this patent is extended or adjusted under 35 U.S.C. 154(b) by 376 days.

(21) Appl. No.: 14/383,662

(22) PCT Filed: Mar. 6, 2013

(86) PCT No.: PCT/EP2013/054488
§ 371 (c)(1),
(2) Date: Sep. 8, 2014

(87) PCT Pub. No.: WO2013/135538
PCT Pub. Date: Sep. 19, 2013

(65) Prior Publication Data

US 2015/0031270 A1 Jan. 29, 2015

(30) Foreign Application Priority Data

Mar. 11, 2012 (GB) ..... 1204253.7

(51) Int. Cl.
*B24C 7/00* (2006.01)
*B24C 1/04* (2006.01)
*B24C 3/00* (2006.01)

(52) U.S. Cl.
CPC ..... *B24C 7/0015* (2013.01); *B24C 1/045* (2013.01); *B24C 3/00* (2013.01); *B24C 7/003* (2013.01); *B24C 7/0023* (2013.01)

(58) Field of Classification Search
None
See application file for complete search history.

(56) References Cited

U.S. PATENT DOCUMENTS 4,854,090 A * 8/1989 Heron ..... B24C 7/0007 451/101
4,862,649 A * 9/1989 Davis ..... B24C 7/0076 406/169

(Continued)

FOREIGN PATENT DOCUMENTS

EP 1825958 A1 8/2007
EP 2097223 A1 9/2009
WO WO-2011070154 A1 6/2011

OTHER PUBLICATIONS

International Search Report PCT/ISA/210 for International Application No. PCT/EP2013/054488 dated Mar. 6, 2013.

(Continued)

*Primary Examiner* — Joseph J Hail
*Assistant Examiner* — Brian D Keller
(74) *Attorney, Agent, or Firm* — Harness, Dickey & Pierce, P.L.C.

(57) ABSTRACT

An abrasive jet system for producing an abrasive cutting jet is provided. The system includes a source of abrasive suspension connected via a conduit to a cutting head. A source of displacement fluid is provided to flush abrasive suspension in the conduit towards the source of abrasive suspension, when the pressure at the source of abrasive suspension is below the pressure at the source of displacement fluid and no water jet is present in the cutting head. Also provided is a method for suspending a settled or partly settled bed of abrasive.

28 Claims, 4 Drawing Sheets

(56) References Cited

U.S. PATENT DOCUMENTS

| | | | | |
|---|---|---|---|---|
| 4,872,293 | A | 10/1989 | Yasukawa et al. | |
| 5,018,317 | A | 5/1991 | Kiyoshige et al. | |
| 5,279,075 | A * | 1/1994 | Sage | B24C 1/00 451/2 |
| 6,276,993 | B1 * | 8/2001 | Miller | B24C 1/045 451/101 |
| 7,222,640 | B2 * | 5/2007 | Gadd | B24C 1/045 137/625.46 |
| 7,934,977 | B2 | 5/2011 | Hashish | |
| 2003/0092364 | A1 * | 5/2003 | Erickson | B24C 1/045 451/75 |
| 2003/0134913 | A1 * | 7/2003 | Zhang | B01J 8/008 518/726 |
| 2007/0028972 | A1 * | 2/2007 | Gadd | B24C 1/045 137/625.46 |
| 2007/0207702 | A1 | 9/2007 | Trieb et al. | |
| 2010/0120332 | A1 * | 5/2010 | Miller | B24C 9/00 451/5 |

OTHER PUBLICATIONS

Written Opinion of the International Searching Authority PCT/ISA/237 for International Application No. PCT/EP2013/054488 dated Mar. 6, 2013.

* cited by examiner

ABRASIVE JET SYSTEM

TECHNICAL FIELD

This invention relates to systems that feed abrasive particles suspended in water to cutting heads of abrasive waterjet apparatus.

BACKGROUND

Ultrahigh pressure water is converted into a high velocity waterjet within a cutting head of an entrainment abrasive waterjet apparatus. The waterjet traverses a chamber within the cutting head that has a passaged connection through which abrasive particles in a carrier fluid enter the chamber. The waterjet passes out the chamber entering a contracting inlet and bore of a focus tube entraining abrasive particles and carrier fluid into the focus tube bore. In the focus tube bore momentum is exchanged between the waterjet and abrasive particles to generate an abrasive cutting jet at a focus tube outlet.

For brevity an abrasive cutting jet is hereafter referred to as a cutting jet. Focus tubes are also known in the art as mixing tubes, abrasive waterjet nozzles and nozzles.

Cutting jets with diameters above 200 microns require abrasive particles with mean diameters greater than 40 microns or so to cut effectively. Such particles are free flowing, easy to meter and to transport dynamically by airflow in tubing to a cutting head. Generating cutting jets with diameters less than 200 microns requires abrasive particles with diameters less than 40 microns or so, with particle diameters dropping to 10 microns or so for a 50 micron diameter cutting jet. As abrasive particle diameters diminish below 40 microns inter-particle forces and friction between particles increase rapidly so that particles flow less readily and particle clumping becomes a serious problem because of rapid moisture absorption by fine abrasive exposed to the environment. When carried in airflow particles less than 40 microns or so in diameter tend to attach to tube walls and cutting head passage walls as a result of electrostatic forces. Particles attached to cutting head passage walls can be wetted, particularly during the starting and stopping of water flow and this can lead to clumping of particles followed by blockage. These factors make it difficult or impossible to meter and feed abrasive particles less than 40 microns mean diameter or so from a hopper to a cutting head by dynamically suspending abrasive particles in airflow.

When particle diameters are such that they cannot be satisfactorily metered and carried dynamically to a cutting head in airflow it is necessary to change the particle carrier fluid to water or another liquid. The transport method of this patent application involves temporarily suspending abrasive particles in sufficient water or other liquid to flow to a cutting head. Since water is the preferred liquid this is referred to thought out the text. Abrasive particles that are temporarily suspended in water are referred to as abrasive suspension thought out the text. The term abrasive in the text is taken to mean abrasive particles.

Cutting heads that entrain abrasive suspension have been known in the art for over 30 years but have not been exploited commercially for precision machining. Reasons for this include poor cutting performance, relative to cutting heads that entrain abrasive in airflow, and complex, unreliable and difficult to operate abrasive suspension feed systems.

Many applications in micromachining would benefit from the unique cutting capabilities of abrasive waterjets. The poor cutting performance of cutting heads that entrain abrasive suspensions has recently been addressed by the inventor in patent applications EP 2 097 223 B1, and WO2011/070154 A1. In particular the cutting heads of said patent applications can be used to generate cutting jets with diameters down to 50 microns or so. To exploit the cutting heads of said patent applications requires the development of abrasive suspension feed systems that are effective, easy to use and reliable.

The processes involved in feeding temporarily suspended abrasive in water to a cutting head are fundamentally different and considerably more complex than the processes involved in carrying abrasive to a cutting head dynamically suspended in airflow. When abrasive is temporarily suspended in water rheological processes are involved that are both time and shear dependent and these processes affect metering, flow behaviour and phase separation by gravity and water migration. Importantly a number of cutting head abrasive feed parameters that are independent parameters when abrasive flows to a cutting head dynamically suspended in airflow become dependent parameters when a cutting head entrains abrasive suspension. The change from independent to dependent cutting head parameters greatly increases the level of control and automation needed to operate abrasive waterjet apparatus as part of a machine tool compared to abrasive waterjet apparatus that feed abrasive to a cutting head dynamically suspended in air Prior art, such as described in U.S. Pat. No. 4,872,293, demonstrates that fine abrasive suspensions can be fed to cutting heads but do not teach how to design abrasive feed systems that make machining with abrasive suspensions commercially practical. Prior art does not address a number of aspects of the design and operation of abrasive suspension feed systems that must be satisfied when abrasive waterjet apparatus is part of a machine tool. These aspects include avoiding particle jamming followed by flow passage blockage, avoiding settling of abrasive suspensions during machining cycles, control over abrasive concentration in abrasive cutting jets and the automation and integration of an abrasive suspension feed system with a machine tool. All of these aspects are addressed by the present invention.

The flow of solid/liquid mixtures with a high solids concentration are particularly prone to particle jamming that leads on to blockage formation in conduits and within flow system components. Once jamming occurs a blockage develops and grows as liquid percolates through the blockage and additional particles are deposited. Increasing pressure to clear a blockage can consolidate the blockage. This means a system usually has to be dismantled to physically remove a blockage. Minimising problems caused by blockages in solids/liquid flow systems plays an important role in the design and operation of solid/liquid flow systems. Prior art related to abrasive suspension feed systems for cutting heads of abrasive waterjet apparatus is quiet about jamming problems.

The smaller the particle size the lower the risk of blockage formation. Other parameters being equal the greater the particle diameter the higher the cutting speed. To achieve efficient cutting it is necessary to cut with particles having mean diameters that approach those that could lead to a blockage occurring in the bore of a cutting head focus tube. Particle diameters are desirably 20% or so of the diameter of a focus tube bore. Although not explicitly stated, prior art abrasive suspension feed systems, such as described in U.S. Pat. No. 4,872,293, did not optimise particle sizes relative to focus tube diameters and operated with abrasive particles too small for efficient cutting. Such systems are much less prone to blockages than systems operating with particle sizes optimised for efficient cutting.

Blockages are most likely at flow restrictions, regions of settled abrasive in tubing and flow passages and when de-watering occurs due to water wicking or migration. The accepted practice in the design of solid/liquid flow systems is to avoid steeply sloping conduits in order to minimise movement of solids when flow is stopped. In steeply sloping and vertical sections of small bore conduits, such as plastic tubing used in connections to abrasive waterjet cutting heads, abrasive particles tend to settle to form a series of plugs with essentially clear water in between. Because particles only settle over a distance of a few tube diameters blockages form quickly in steeply sloping tubing. Prior art is silent about the problems of abrasive settling in steeply sloping small bore tubing. Steeply sloping small bore conduits are unavoidable in feeding abrasive suspension to a cutting head of an abrasive waterjet apparatus so the abrasive suspension feed systems described in this patent application are designed and their operation automated to prevent problems caused by abrasive settling in steeply sloping tubing.

SUMMARY OF THE INVENTION

An object of the invention is to alleviate the above and other drawbacks of the prior art. This is achieved by the invention as defined in the accompanying claims.

The present invention is based on the realisation that by controlling the pressure at a source of abrasive suspension conduits and tubes in an abrasive jet system may be efficiently kept free from clogging. In particular, the inventor has realised that by providing a displacement fluid at or near the cutting head, and controlling the pressure at said source of abrasive suspension to be below the pressure at the provided displacement fluid, a flushing/cleaning flow towards the source of abrasive suspension may be created.

Thus, according to at least one aspect of the invention, an abrasive jet system for producing an abrasive cutting jet is provided, the abrasive jet system comprising

- a cutting head adapted to receive pressurised water to generate a high velocity waterjet,
- a source of abrasive suspension,
- a conduit for providing the source of abrasive suspension in fluid communication with the cutting head,
- an abrasive suspension on/off valve provided in said conduit and having an open state and a closed state,
- a source of displacement fluid in fluid communication with a portion of said conduit located between the cutting head and the abrasive suspension on/off valve, wherein the pressure at said source of abrasive suspension is controllable to be below the pressure at said source of displacement fluid,
- wherein when said abrasive suspension on/off valve is open and said high velocity waterjet is present in the cutting head, the abrasive suspension flows via said conduit into the cutting head and is entrained by the high velocity waterjet to produce an abrasive cutting jet, and
- wherein when the cutting head is void of high velocity waterjet and said pressure at the source of abrasive suspension is below the pressure at said source of displacement fluid, and said abrasive suspension on/off valve is opened, abrasive suspension present in the conduit is displaced towards said source of abrasive suspension.

The source of abrasive suspension may be located in a hopper containing a suspended abrasive bed, such as at an inlet to a conduit. Alternatively, the source of abrasive suspension, may be located at a point outside such a hopper, such as in a flow circuit for circulating water from/to the hopper.

The pressure at the source of abrasive suspension may be controlled in various alternative ways. For instance, the pressure may be controlled by control means connected to a pump, a variable restriction and/or a vacuum source.

According to at least one exemplary embodiment, said pressure at said source of abrasive suspension is a subatmospheric pressure. Thus, the pressure at the source of displacement fluid may be at atmospheric pressure. Alternatively, if the source of abrasive suspension is at atmospheric pressure, than the pressure at the source of displacement fluid must be higher than atmospheric pressure.

According to at least one exemplary embodiment, the abrasive jet system comprises a control system for controlling the opening and closing of said abrasive suspension on/off valve, wherein when said abrasive suspension on/off valve is closed, and the cutting head is void of high velocity waterjet, the control system is adapted to, within a predetermined time period, open said abrasive suspension on/off valve to allow displacement fluid to displace abrasive suspension present in the conduit towards said source of abrasive suspension. The control system may suitably control an actuator which is operatively connected to the valve for opening/closing the valve. Furthermore, if a separate valved source of displacement fluid is present in the system, the control system may be adapted to also control the opening and closing of the valve at said source of displacement fluid. Thus, with said control system, the clearance of abrasive from the conduit may be automated.

According to at least one exemplary embodiment, the abrasive jet system comprises

- a hopper containing a bed of abrasive particles which, in operation of the abrasive jet system, is suspended, and
- a flow circuit having an inlet end and an outlet end which are in fluid communication with said hopper,
- wherein said conduit is connected to said flow circuit at a junction point, wherein said junction point represents said source of abrasive suspension. This allows the source of abrasive suspension to be located close to the cutting head. This also allows a greater flow of abrasive suspension in the flow circuit compared to the flow to the cutting head, wherein pressures in the flow circuit does not change significantly when abrasive suspension to the cutting head is started and stopped.

Thus, according to at least one exemplary embodiment, the flow in said flow circuit is greater than the flow in said conduit to the cutting head, such as more than 2 times greater, for instance 5 times greater.

According to at least one exemplary embodiment, the abrasive jet system comprises

- a control unit for controlling the pressure at said junction point, and
- a pressure sensing device which monitors the pressure in the flow circuit in the vicinity of said junction point to provide a signal indicative of said pressure to the control unit.

According to at least one exemplary embodiment, the abrasive jet system comprises a pump in the flow circuit downstream of said junction point, wherein the pressure at the junction point is controlled by controlling the flow through the pump. In other words, the pump is located between said junction point and the outlet end of the flow circuit.

According to at least one exemplary embodiment, said pump is in the form of a peristaltic pump with variable speed drive, wherein the pressure at the junction point is controlled by controlling the speed of the pump.

According to at least one exemplary embodiment, said control unit is operatively connected to the pump and adapted to control the speed of/flow through the pump based on said signal from the pressure sensing device, thereby controlling the pressure at said junction point.

According to at least one exemplary embodiment, the abrasive jet system comprises a variable restriction in the flow circuit upstream of said junction point, wherein the pressure at the junction point is controlled by controlling the flow through the restriction. In other words, the variable restriction is located between the inlet end of the flow circuit and said junction point.

According to at least one exemplary embodiment, said variable restriction is in the form of an actuator that acts on flexible tubing to cause a pressure drop to lower the pressure at said junction point. For instance, the actuator may comprise a clamp.

According to at least one exemplary embodiment, said control unit is operatively connected to the variable restriction and adapted to vary the restriction based on said signal from the pressure sensing device, thereby controlling the pressure at said junction point.

According to at least one exemplary embodiment, the abrasive jet system comprises a focus tube having an outlet from which said cutting jet is discharged, the focus tube being submerged in ambient fluid, thereby allowing ambient fluid to enter through the focus tube through said outlet when said cutting jet is not discharged, wherein, when said cutting jet is not discharged, said source of displacement fluid is the ambient fluid entered in the focus tube.

According to at least one exemplary embodiment, a valved source of displacement fluid is connected to the cutting head via a valved connection such that when there is no waterjet present in the cutting head, opening the source of displacement fluid valve and opening the abrasive suspension on/off valve in the first conduit causes abrasive suspension to be displaced from the conduit towards the source of abrasive suspension, and when said waterjet is present in the cutting head, opening the source of displacement fluid valve causes displacement fluid to flow to the cutting head to be entrained by the waterjet.

According to at least one exemplary embodiment, said hopper includes cover water above the bed of abrasive particles, the abrasive jet system further comprising a control system, and an agitator for agitating said bed of abrasive particles, the agitator being controlled by the control system, wherein the dimensions of said hopper is such that the agitated bed of abrasive particles are maintained with a depth of cover water above the bed such that the cover water surface is essentially quiescent.

According to at least one exemplary embodiment, the inlet end of the flow circuit is positioned at or positionable to a location in the agitated bed of abrasive particles where the abrasive concentration is that required at the cutting head.

According to at least one exemplary embodiment, water is fed into said hopper either directly or into the flow circuit downstream of said junction point.

According to at least one exemplary embodiment, said hopper is provided with an overflow.

According to at least one exemplary embodiment, said hopper is mounted on a weight sensor for determining the amount of abrasive in said hopper.

According to at least one exemplary embodiment, said agitator is movable between said bed of abrasive particles and said cover water. It should be understood that movement of the agitator between the bed and the cover water should be regarded as a relative displacement. Thus, in some embodiments, the agitator may be lowered and raised, while the hopper is kept still. Reversely, in other embodiments the hopper may be raised and lowered.

According to at least one exemplary embodiment, said inlet end of the flow circuit is movable between said bed of abrasive particles and said cover water. Again, this is to be regarded as a relative displacement between the inlet end and the hopper. Suitably, also the outlet end may be movable relative to the hopper so that its position may be changed between said bed of abrasive particles and said cover water.

According to at least one exemplary embodiment, a source of dry abrasive particles is provided above the surface of the cover water. The source may, for instance, be in the form of a silo.

According to at least one exemplary embodiment, said control system is operatively connected to the weight sensor and the source of dry abrasive particles in order to control the discharging of dry abrasive particles from said source of dry abrasive particles onto the surface of the cover water based on an input signal from the weight sensor.

According to at least one exemplary embodiment, said agitator is driven by a variable speed motor and provides a signal of the torque on the agitator.

According to at least one exemplary embodiment, said control system is programmed to start up an abrasive feed system by with the agitator positioned in the cover water start up the agitator, measuring the torque on the agitator, repositioning the agitator into the abrasive bed in the hopper at such a rate that a predetermined torque on the agitator is not exceeded. The control system may suitably comprise a computer in which a value corresponding to said predetermined torque may be set/stored.

According to at least one exemplary embodiment, said control system is programmed to start up an abrasive feed system by with the agitator positioned in the cover water starting up the agitator, measuring the torque on the agitator, repositioning the agitator into the abrasive bed in the hopper at such a rate that a predetermined load change on the weight sensor is not exceeded. A value representing the said predetermined load change may suitably be stored in a computer that is included in the control system.

According to at least one exemplary embodiment, during said start up, said control system is further programmed to with the inlet end of the flow circuit positioned in the cover water start up the pump, and reposition the inlet end of the flow circuit into the abrasive bed.

According to at least one exemplary embodiment, said control system is programmed to shut down the abrasive feed system in such a manner as to be able to automatically re-start the abrasive feed system, wherein when shutting down the abrasive feed system the control system stops the agitator, re-positions the agitator and the inlet end of the flow circuit into the cover water, and opens the abrasive suspension on/off valve to clear abrasive from said conduit followed by closing the abrasive suspension on/off valve, and after a sufficient time period to clear abrasive from the flow circuit stops the pump.

According to at least one other aspect of the invention, there is provided a method of suspending a settled or partly settled bed of abrasive particles provided in a hopper of an abrasive jet system, the method comprising providing a layer of cover water above said bed, providing an agitator suitable for agitating said bed, setting a limit value for a torque on the agitator, positioning the agitator in the cover water, starting up the agitator when positioned in the cover water, measuring the torque on the agitator, and moving the agitator into said bed at such a rate that said limit value is not exceeded.

According to at least one exemplary embodiment, the method further comprises mounting the hopper on a weight sensor for determining the amount of abrasive particles in said hopper, setting a limit value for load changes on the weight sensor, wherein the step of moving the agitator into said bed comprises moving the agitator into said bed at such a rate that said limit value for load changes is not exceeded.

According to at least a further aspect of the invention, there is provided a method of suspending a settled or partly settled bed of abrasive particles provided in a hopper of an abrasive jet system, the method comprising providing a layer of cover water above said bed, mounting the hopper on a weight sensor for determining the amount of abrasive particles in said hopper, setting a limit value for load changes on the weight sensor, providing an agitator suitable for agitating said bed, positioning the agitator in the cover water, starting up the agitator when positioned in the cover water, and moving the agitator into said bed at such a rate that said limit value is not exceeded.

According to at least one exemplary embodiment, the just-mentioned method further comprises setting a limit value for a torque on the agitator, measuring the torque on the agitator, wherein the step of moving the agitator into said bed comprises moving the agitator into said bed at such a rate that said limit value for a torque on the agitator is not exceeded.

According to at least some exemplary embodiments, the above methods comprise providing a source of dry abrasive particles above the surface of the cover water, discharging dry abrasive particles from said source of dry abrasive particles onto the surface of the cover water based on an output from said weight sensor in order to keep the amount of abrasive particles in the hopper within a predetermined range.

According to at least some exemplary embodiments, the above methods comprise providing a flow circuit having an inlet end and an outlet end which are in fluid communication with said hopper, and a conduit connecting the flow circuit to a cutting head adapted to receive pressurised water to generate a high velocity waterjet, positioning said inlet end and said outlet end in the cover water, pumping a flow of cover water through the flow circuit, suitably before starting up the agitator, and moving the inlet end into said bed so as to enable suspended abrasive particles to be feed to the cutting head.

According to at least some exemplary embodiments, the above methods comprise providing an abrasive suspension on/off valve in said conduit, and opening said on/off valve after a period of time when the concentration of abrasive particles at the location of the inlet end of the flow circuit is that required at the cutting head.

According to at least some exemplary embodiments, the above methods comprise performing a temporary shut down before performing a restart, wherein performing the shut down comprises stopping the agitator, moving the agitator, and suitably the inlet end of the flow circuit, away from the bed and into the cover water, wherein performing the restart comprises performing the steps in the previously discussed exemplary embodiments of the methods.

According to at least some exemplary embodiments, the above methods comprise, opening said on/off valve, after a time delay to allow abrasive suspension to be cleared from the cutting head back to the flow circuit, closing said on/off valve, pumping/circulating cover water through the flow circuit to flush out abrasive from the flow circuit, and after a further time delay, stop pumping/circulating the cover water.

According to at least yet another aspect of the invention, an abrasive jet system for producing an abrasive cutting jet is provided, the abrasive jet system comprising a cutting head adapted to receive pressurised water to generate a high velocity waterjet, a hopper containing a bed of abrasive particles which, in operation of the abrasive jet system, is suspended, wherein said hopper includes cover water above the bed of abrasive particles, a conduit for providing abrasive suspension to the cutting head, a control system, and an agitator for agitating said bed of abrasive particles, the agitator being controlled by the control system, wherein the dimensions of said hopper is such that the agitated bed of abrasive particles are maintained with a depth of cover water above the bed such that the cover water surface is essentially quiescent, wherein said control system is programmed to start up the agitator when the agitator is positioned in the cover water, and to move the started agitator into the abrasive bed at such a rate that a predetermined torque on the agitator is not exceeded, or at such a rate that a predetermined load change on an optional weight sensor is not exceeded.

According to at least some exemplary embodiments of the just-mentioned abrasive jet system said control system is adapted to control the operation and positioning of the items defined in the methods according to the previously mentioned aspects of the invention, including the starting, stopping and positioning of the agitator, the discharging of abrasive particles from the source of dry abrasive particles, the positioning of the inlet end and the outlet end of the flow circuit, the pumping/circulating of a flow of cover water through the flow circuit, the controlling of the on/off valve.

Solid/liquid flow systems are usually designed and operated such that solids are flushed from a system before flow is stopped. The flow of abrasive suspension to a cutting head may be stopped and restarted over time periods ranging from a fraction of a second to sufficient time for abrasive settling to occur that would lead to a blockage on re-commencement of flow. In implementations of this invention abrasive suspension feed systems are designed and control systems provided such that abrasive suspension is generally available for entrainment at a cutting head but is flushed out of parts of a feed system if cutting will not, or does not occur, within a set time period. This time period can be less than a minute. Prior art does not consider or reveal how to design abrasive feed systems that feed cutting heads of abrasive waterjet apparatus that forms part of a machine tool that experiences dynamic cutting cycles interposed with variable periods of inactivity.

Flow passage dimensions close to and within a cutting head are restricted and are the locations of highest risk for blockage formation. An event upstream of a cutting head that generates a slug of abrasive suspension with a higher than desired abrasive concentration can to lead to a blockage when the abrasive rich suspension reaches a cutting head. In implementations of this invention close control is maintained over abrasive suspension rheological properties and concentration at the source point of abrasive suspension and whilst it is flowing to a cutting head.

The inventor has found that pressure fluctuation enhances water migration in fine abrasive suspensions making dewatering particularly problematic when fluctuations are present, such as from a pump or from multiple short cutting cycles when drilling holes in thin material. Dewatering phenomena are caused by dilatancy of high abrasive concentration suspensions with water preferentially migrating through a suspension towards a region of lower pressure. Implementations of this invention minimise problems caused by dilatancy phenomena.

Regions of re-circulating flow occur in cavities in passages, such as at a junction between conduits when there is no flow in one of the junction legs. The inventor has found that fine abrasive particles accumulate in cavities at flow junctions and de-water at a rate that is markedly influence by pressure fluctuations. Within minutes an abrasive rich plug can form that completely fills a non-flowing junction leg and continues to grow to extend five or more passage diameters into a non-flowing leg of a junction. Even before an abrasive rich plug forms sufficient dewatering can occur that when cutting is restarted abrasive suspension that has begun to dewater can cause a blockage when it reaches the small diameter passages within or close to a cutting head. Implementations of this invention mitigate the effects of dewatering principally by periodically clearing abrasive from a non-flowing junction leg when cutting is stopped for longer than a set time.

The normal practice is to avoid restrictions in solid/liquid flow systems and in particular restrictions that cause a substantial pressure loss, such as at a control valve. For this reason flow control of solid/liquid systems is usually achieved by variable pumping. Prior art related to abrasive suspension feed systems to cutting heads, such as U.S. Pat. No. 4,872,293, include a valve in the abrasive suspension system to control the abrasive suspension flow to a cutting head and hence the abrasive concentration in a cutting jet. To provide effective control over the flow of abrasive suspension to a cutting head the flow restriction passage/s in a control valve need to be considerably smaller than flow passages elsewhere in an abrasive feed system including those within a cutting head. A blockage could be expected to occur as soon as a valve in a feed conduit to a cutting head, such as show in U.S. Pat. No. 4,872,293, was closed sufficiently to control abrasive suspension flow containing abrasive particles of optimal size, relative to a focus tube bore diameter, for effective cutting. Prior art related to feeding abrasive suspension to cutting heads is silent about particle jamming at control valves.

In embodiments of this invention the pressure of abrasive suspension flowing to a cutting head is controlled using a combination of a pump and control valve that typically operate on a flow of abrasive suspension that is 5 or so times the amount entrained by a cutting head. With a flow of abrasive suspension substantially greater than that entrained at a cutting head the flow passage dimensions within a control valve are such as not to cause blockages. Alternatively in other embodiments it is described how controlling the pressure within an abrasive suspension feed vessel obviates the need for or reduces the duty of a pressure control valve.

Abrasive particles used by abrasive waterjet apparatus are three to four times denser than water and settle to form a bed unless agitated or caused to flow to maintain particles in suspension in conduits and passageways. Firmly settled fine abrasive acts like a solid and can be handled and broken into chunks.

The use of additives to delay or virtually prevent settling of abrasive particles is well known in the art however, problems caused by the use of additives in abrasive suspensions for abrasive waterjet apparatus are not treated in the art. In the case of abrasive feed systems to entrainment cutting heads the use of additives introduce additional variables that the inventor has found make it difficult if not impractical to achieve predictable abrasive concentration in cutting jets. Suspending abrasives using additives results in a substantial increase in viscosity and in complex and time dependent non-Newtonian flow behaviour. Also the inventor has found that additives cause a loss in cutting performance, the reason for which is unknown. The use of additives considerably increases the complexity and costs of the abrasive suspension preparation process. The inventor has found that it is desirable for an abrasive suspension feed systems to operate without additives that delay abrasive settling but to have the option to use additives if for particular mode of cutting operations they provide benefits such as minimising dewatering due to dilatancy.

When abrasive particles are carried to a cutting head dynamically suspended in air the air mass is only 3 wt % or so of the abrasive mass. When abrasive is temporarily suspended in water the water typically accounts for 30 wt % or more of the total mass accelerated by a waterjet. The carrier water accelerated by a waterjet reduces the amount of momentum transferred to abrasive particles and hence reduces cutting performance. It is, therefore, desirable to use as high an abrasive concentration as practical. In effect this means operating with an abrasive concentration just below the level where a small increase in abrasive concentration causes a steep rise in apparent viscosity and in the risk of blockages. Depending on abrasive material and particle diameters, the optimum abrasive concentration is typically between 60 and 70 wt %.

By using a shear thinning additive the inventor has found that it is possible to increase the abrasive content of a fine abrasive suspension above 70 wt % or so whilst maintaining good fluidity. However, effective additives that allow abrasive concentration to be increased reduce particle-settling times and a settled bed becomes very dense and difficult to re-suspend without physical intervention. To ensure that dense settling does not occur in a feed system it is necessary to have close control over an abrasive feed system in which an additive, such as a polymer acrylic dispersant, is used to maximise abrasive concentration. Implementations of the abrasive suspension feed systems of this patent application provide the necessary control for shear thinning additives to be or more preferably not to be used.

Feeding abrasive particles in paste form or suspended in foam to a cutting head, such as described in U.S. Pat. No. 7,934,977, reduces the amount of carrier water accelerated by an abrasive waterjet compared to entraining abrasive suspension. A paste needs to be extruded to flow to a cutting head and this involves complex processes and systems for feeding the abrasive paste to cutting heads. Systems for reliably feeding abrasive paste to cutting heads of entrainment abrasive waterjet apparatus have yet to be described. Using foam additives to reduce the amount of water needed to transport abrasive particles to a cutting head introduces many poorly controllable variables and no method has been described in the art for consistently and reliably feeding abrasive suspended in foam to a cutting head of an abrasive waterjet apparatus that is part of a machine tool.

Abrasive particles for abrasive waterjet cutting are usually garnet, olivine or aluminium oxide particles that have specific gravities of about 4. Isolated particles of these abrasives, with a diameter appropriate to a particular cutting head focus tube diameter, settle within a second or so in the passages local to and within a cutting head. However, interference between particles in high abrasive concentration suspensions greatly reduces settling velocities so non-flowing fine abrasive suspension can usually remain in passageways of an abrasive waterjet feed system for a minute or so and the flow restarted without problems. Non-cutting periods during normal cutting operations can exceed the time over which flow can be restarted without problems so means of clearing abrasive from passageways is necessary. In implementations of this invention actions to remove abrasive particles from parts of an abrasive feed system, when unacceptable levels of settling are likely, are programmed into the control system of an abrasive waterjet apparatus. Prior art is silent about the need to automate the operation of abrasive suspension feed systems to accommodate abrasive particles settling.

The practice with abrasive carried to a cutting head dynamically suspended in airflow is to have a local hopper mounted on the cutting head motion system that is automatically topped up from a bulk hopper. The capacity of a local hopper on a motion system is preferably limited to a volume sufficient to supply abrasive to a cutting head for a few minutes. A local hopper feeding abrasive particles carried in airflow includes an abrasive shut off valve and an abrasive metering means. An abrasive metering means discharges abrasive particles into airflow generated by a cutting head and particles are carried in the airflow through tubing to a cutting head. It is arranged that the amount of air entrained by a cutting head is considerably more than that necessary to carry abrasive particles to a cutting head. Abrasive flow rate is, therefore, independent of airflow rate and independent of the air entrainment performance of a cutting head.

The successful exploitation of abrasive waterjets that entrain abrasive particles carried in airflow is greatly aided by the abrasive concentration in a cutting jet being independent of carrier airflow rate and independent of the air entrainment performance of a cutting head. The low density of air causes little loss of cutting performance when substantially more air is entrained than the minimum necessary to carry abrasive to a cutting head. Because close control over the amount of air entrained is not required, good cutting performance can be achieved with a wide range of cutting head internal geometries and with considerable wear of a focus tube bore and other cutting head components.

Entraining abrasive temporarily suspended in water, rather than dynamically suspended in air, results in the loss of the benefits of abrasive concentration in cutting jets being independent of carrier fluid flow rate and independent of cutting head entrainment performance. When entraining abrasive suspension the abrasive concentration in a cutting jet is dependent on the carrier fluid flow rate, the abrasive concentration in the abrasive suspension and on the cutting head entrainment performance. This means many more fluid dynamic processes and geometric parameters affect the feeding of abrasive suspension to a cutting head than when abrasive is carried to a cutting heads dynamically suspended in airflow.

Ideally abrasive suspension flow to a cutting head should be accurately metered. However, accurate metering of small flows of high concentration abrasive suspension is extremely difficult. It is not practical to adapt any known solid in liquid metering technology to measure abrasive suspension flow to a cutting head of an abrasive waterjet apparatus. This is because of a combination of several of the following: high abrasive concentration, highly abrasive material, small flow rates, particles jamming, multiple cutting cycles per second, weight and space limitations and proximity to a cutting process.

Without a means of directly metering abrasive flow to a cutting head other means have been developed by the inventor.

When entraining abrasive suspension the abrasive concentration in a cutting jet is dependent on the:

a) concentration of abrasive in an abrasive suspension
b) rheological properties of an abrasive suspension
c) agitation and flow history of an abrasive suspension that affects its fluidity
d) entrainment performance of a cutting head, which is dependent on cutting head geometric parameters that include those that affect a waterjet's entrainment characteristics with the diameter at the start of a focus tube bore being an important geometric parameter as regards abrasive suspension entrainment and this dimension changes as a focus tube wears
e) abrasive feed system flow characteristics between a cutting head and the point in a system where a pressure acts to cause abrasive mixture to flow to a cutting head
f) pressure that acts to cause abrasive mixture to flow to a cutting head, Constant abrasive concentration and rheological properties of a suspension can be controlled by suspension preparation. A consistent agitation and flow history of abrasive suspension arriving at a cutting head is achieved by ensuring abrasive suspension flowing to a cutting head experiences similar agitation and flow conditions and that these conditions destroy a suspensions prior flow history. Cutting head geometric parameters are controlled by tolerancing at the micron level on critical cutting head component dimensions. Predictive modelling can be used to account for changes in geometry as a focus tube wears.

With the variability of a number of parameters controlled or predictable, the variable available to control abrasive concentration in a cutting jet is the pressure differential between a cutting head entrainment chamber and the point in a feed system where control can be exercised over the abrasive suspension pressure. The point of pressure control needs to be as close to a cutting head as practical so as to minimise the effects on abrasive suspension flow of time and shear dependent flow processes between the point of pressure control and a cutting head. If a local hopper is used the driving pressure is the pressure difference between the point abrasive suspension enters the conduit out of a hopper and the cutting head.

When abrasive is carried to a cutting head by airflow a major reason for a local hopper close to a cutting head is to minimise the time between cutting cycles. It is essential to clear abrasive carried in air from tubing and a cutting head before a waterjet is stopped, otherwise abrasive remaining in tubing and a cutting head settles and particles in a cutting head may be wetted. When settled abrasive is present in tubing or wetted abrasive is present in a cutting head a blockage is highly likely in cutting head flow passages or in a focus tube bore on restarting water flow to a cutting head.

Abrasive particles carried in air through tubing to a cutting head travel at over 10 m/s and the amount of abrasive in transit between a hopper and a cutting head is equivalent to less than a tenth of a second of cutting time. Abrasive suspension velocities in tubing to a cutting head are typically less than 1 m/s and the amount of abrasive in transit in the connection to a cutting head can amount to seconds of cutting time. Clearing abrasive suspension from the feed system to a cutting head every time cutting is stopped is not practical or necessary as abrasive suspension can remain in tubing and cutting head passages for a minute or so before its rheological properties deteriorate to cause blockage problems.

In implementations of this invention a local hopper or other form of local sink is provided into which abrasive suspension from cutting head passages and tubing is displaced when the time delay between the end of one cutting cycle and the start of the next exceeds a set value. It is also arranged that the point source of abrasive suspension can be located close to a cutting head to minimise the delay caused by priming a feed system after it has been flushed of abrasive suspension. The inventor has found there are considerable advantages if the source of abrasive suspension is not a local hopper mounted on a cutting head motion system.

In implementations of this invention abrasive suspension with essentially constant properties and flow history is provided at a cutting head by withdrawing abrasive suspension from a flow circuit passing close to a cutting head in which substantially more abrasive suspension than is needed by a cutting head is flowing. Means are provided for abrasive suspension with consistent flow induced rheological properties to be maintained in such a flow circuit. With five or so times the flow in a circuit, compared to the flow to a cutting head, pressures in a flow circuit do not change significantly when abrasive suspension flow to a cutting head is started and stopped.

In implementations of this invention pressure at the point close to or at a cutting head where abrasive suspension is bled off from a flow circuit is controlled by the suspensions rheological properties, the location of a pump in a flow circuit and the pumping rate and if required by a controllable restriction. A restriction acts on a larger flow rate than the flow to a cutting head and this allows restrictor passage dimensions that are much less conducive to blockages than if a restrictor was located in the abrasive suspension feed connection to a cutting head.

Cutting heads described in EP 2 097 223 B1, and WO2011/070154 A1 are capable of drawing vacuums that are over 80% of the way from atmospheric pressure to an absolute vacuum. It has been found by the inventor that a cutting head capable of drawing such a vacuum entrain too much abrasive suspension from a source that is at atmospheric pressure. This means the pressure at the point where abrasive mixture flows from a source has to be below atmospheric pressure in order to limit the rate at which abrasive suspension is entrained by a cutting head. Source vacuums can exceed 400 mm Hg to achieve desired abrasive concentrations in a cutting jet.

In the implementations of this invention the pressure at the point where abrasive mixture is withdrawn from an abrasive suspension source is maintained at below atmospheric pressure in order to be able to clear abrasive mixture from a cutting head and the conduit between the source point and a cutting head. When a waterjet is absent, displacement fluid introduced at a cutting head flows towards the abrasive suspension source. The displacement fluid can be drawn in through the focus tube, in which case it is ambient fluid, either air or water if a focus tube outlet is submerged. Alternatively in embodiments of this invention a valved source of air, water or other fluid is connected to a cutting head entrainment chamber or connected to a conduit between an abrasive suspension on/off valve and a cutting head.

On cessation of cutting an abrasive suspension on/off valve in the tubing connecting an abrasive suspension source and a cutting head is be closed more or less at the same time that a waterjet shut off valve is closed. An abrasive suspension on/off valve is opened more or less concurrent with opening a waterjet shut off valve at the start of a cutting cycle. An exception is when multiple cuts or hole drilling operations are carried out per second when an abrasive suspension on/off valve may not need to be closed between cutting and drilling cycles.

Opening the valve to a source of displacement fluid connected to a cutting head entrainment chamber or to a connection between an abrasive suspension shut off valve and an entrainment chamber results in displacement fluid being entrained instead of abrasive suspension. This means abrasive cutting can be started and stopped by opening and closing a valve to a source of displacement fluid. In implementations of this invention by controlling the flow of displacement water the amount of abrasive suspension entrained and hence the abrasive concentration in a cutting jet is varied.

When cutting is not scheduled before abrasive suspension properties adversely change in a cutting head or in the connection to a source of abrasive suspension, an abrasive suspension on/off valve is opened for a sufficient time for displacement fluid to essentially clear abrasive suspension back to the source. After clearing abrasive suspension back to the source at the point periodic momentary opening of a suspension on/off valve is scheduled to prevent significant de-watering of abrasive local to the point. The timing and duration that an abrasive suspension valve is open to allow displacement fluid to flow towards an abrasive suspension source is programmed into a control system of the abrasive waterjet apparatus. Alternatively in implementations of this invention it is arranged that a valve seals the connection to the point such that no dead space exists in which abrasive suspension can dewater.

Pumping 60 to 70 wt % fine abrasive suspensions with pump inlet vacuum pressures that can fall to 400 mm Hg or so is an extremely demanding duty particularly as a pump must be capable of passing considerable quantities of air as well as abrasive suspension. Peristaltic pumps can meet the duty but by their mode of operation peristaltic pumps produce significant pressure pulsation which if not damped cause striations on workpiece cut surfaces and enhances water migration in abrasive suspension. The inventor has found that pressure pulsation reaching a cutting head can be sufficiently damped using highly flexible tubing, such as silicone rubber, for parts of a flow circuit. However, small fluctuations remain that affect abrasive suspension de-watering and these are allowed for in the design and operation of an abrasive suspension feed system to this invention.

Using conduits formed of flexible tubing allows an actuator to act on tubing to provide an abrasive suspension on/off valve and for a controllable actuator to act on tubing to provide a variable flow valve action. By such means penetrations into a flow circuit are avoided where abrasive could accumulate and cause problems due to abrasive rich slugs of suspension being formed and carried to a cutting head. In implementations of this invention an actuator acts on flexible tubing upstream of the point where abrasive suspension is withdrawn from a flow circuit to flow to a cutting head with the pump located downstream of the point. The valve and pump in implementations of this invention are automatically controlled to maintain a desired pressure at the point where abrasive suspension is bled off from a flow circuit to a cutting head.

Degassing of water can occur in a flow circuits to this invention because the pressure of abrasive suspension is substantially reduced below atmospheric pressure. The inventor has found that gas brought out of solution can reach a cutting head and cause striations on cut surfaces, whilst pressure fluctuations caused by sudden release of air or other gases also cause striations on cut surfaces. Depending on the source of water it may be necessary to partial de-gas water used in the preparation of abrasive suspensions.

Depending on abrasive characteristics, the bottom of an abrasive bed consisting of fine abrasive in a vessel or feed hopper can approach a firmly settled condition in an hour or so. The longer the time period the firmer a bed becomes until a bed can be considered to have become a solid. If fine abrasive in a hopper is allowed to settle the torque to restart agitation can be ten or more times the steady state agitation torque making it essential to avoid agitators becoming embedded in settled fine abrasive. Prior art is silent on how abrasive waterjet apparatus feed systems can be designed to avoid agitators becoming embedded in fine settled abrasive. In implementations of this invention it is described how an agitating device is withdrawn from a bed in a hopper when an abrasive waterjet apparatus is shut down and the agitating device reintroduced into a settled bed in a controlled manner to fluidise a bed prior to commencement of cutting operations.

Fluid motion away from an agitator in an agitated vessel of fine abrasive particles is rapidly damped. As a result of rapid motion damping an agitator introduced into a settled bed of fine abrasive tends to create a cavity with a diameter slightly larger than the agitator diameter. The inventor has found that to mix the full cross-section of an abrasive bed in a hopper an agitator with a diameter 70% or more of a hopper diameter is desirable.

Fine abrasive powders for abrasive waterjet cutting are usually relatively low cost minerals that have been subjected to the minimum classification necessary to produce a powder with a reasonably narrow particle distribution. Abrasive powders contain micron and sub-micron particles that easily become airborne, wetted particles cling to surfaces and dry out as a tenacious film. Abrasive suspension clings to the walls of containers so that it is not possible to fully empty a container and this causes waste. It is, therefore, highly desirable that the equipment for abrasive suspension preparation forms part of an abrasive waterjet apparatus and receives abrasive as dry powder in a way that avoids abrasive drying on surfaces and minimises airborne particles.

Implementations of this invention have a stirred hopper that is automatically top up with dry abrasive manually or automatically from or a bulk storage vessel. Exploiting the physical phenomena of turbulence suppression by a vertical density gradient in fluids, abrasive suspension is withdrawn from an agitated abrasive bed under water cover in a stirred hopper. Using appropriate agitation and bed thickness a relatively quiescent water cover is maintained above an agitated abrasive bed. Dry abrasive particles fed onto the surface of the cover water away from the hopper walls descend in a density current to the agitated abrasive bed with little mixing with the cover water. Water bled into an abrasive bed at a controlled rate and appropriate location helps maintain the desired abrasive concentration at the location where abrasive suspension is withdrawn from the bed. It is arranged that excess water flowing up through a bed over flows at the cover water surface to carry away material in the abrasive feed that does not wet and floats on the cover water surface.

Importantly the abrasive suspension preparation method of this invention does not require accurate metering of water into an abrasive suspension hopper to achieve the desired abrasive concentration at the point where abrasive suspension is withdrawn from a hopper.

A desired concentration of abrasive in a suspension at the withdrawal location is achieved by a combination of agitation intensity, bed thickness, cover water depth, location of returning abrasive suspension flow into a bed and the location and rate of water flow into a bed. Mounting a hopper on a load cell allows the monitoring and automatic topping up of abrasive in a hopper by dry abrasive from a bulk storage vessel to maintain the abrasive bed thickness.

Instead of bleeding water into an abrasive bed, water is advantageously bled into an abrasive suspension flow circuit between the point abrasive suspension is withdrawn to flow to a cutting head and the pump. The water reduces the abrasive concentration being pumped to make the pumping duty less arduous. It can also be arranged that cover water from a hopper be drawn into a flow circuit between the point and a pump to reduce the severity of a pumping duty.

If it is desirable not to use a peristaltic pump or other directly driven pump in an abrasive suspension flow circuit a jet pump utilising hopper cover water can be used. When this is the case a larger volume hopper is required with sufficient depth of cover water over an abrasive bed to allow adequate settling of abrasive.

If abrasive suspension is re-cycled from a cutting table it can be fed into a hopper at an appropriate level. A hopper design can allow for re-cycled abrasive to enter a hopper as a suspension with a much lower abrasive content than desired at a cutting head by including a settling section in a hopper in which the abrasive concentration increases.

Abrasive suspension is flushed from a flow circuit when an abrasive suspension feed system is shut down for an extended time period. In the case of a hopper that operates with cover water over an abrasive bed, the inlet to an abrasive suspension flow circuit is preferably in the form of a dip tube that is raised into the cover water before a flow circuit is shut down so that cover water is pumped to flush abrasive from a flow circuit.

To operate in a machine tool environment the start-up and shut-down procedures for an agitated hopper and abrasive suspension flow circuit to this invention are programmed into a machine tool's controller. To start the preferred abrasive suspension feed arrangement of this invention the pump in the abrasive suspension flow circuit is started and a flow of cover water from a hopper established in an abrasive suspension flow circuit before starting impeller rotation and raising a hopper so that the impeller re-suspends the abrasive bed. To avoid overloading an agitator as it re-suspends a settled bed the impeller torque or changes in a hopper load cell output are used to control the rate of impeller penetration into a bed. Rather than moving a hopper an impeller and its drive along with the flow circuit dip tubes may be moved relative to a hopper. To shut down an abrasive feed system the agitator is stopped and a hopper lowered until the agitator's impeller and the inlet and return dip tubes are in the cover water. The abrasive suspension shut off valve is then opened and after a time delay to allow abrasive suspension to be cleared from the cutting head back to the point source of abrasive suspension the valve is closed and after a further period to allow cover water to circulate through a flow circuit to flush out abrasive from the circuit the circulation pump is stopped.

It will be appreciated by those skilled in the art that clearing of abrasive suspension from a flow circuit could be carried out by a source of pressurised fluid connected at junctions in the flow circuit. Such junction connections are sites where de-watering of abrasive suspension would occur that could cause problems during operation of an abrasive suspension flow circuit making inlet and return dip tubes that can be relocated into the hopper cover water the preferred option. A source of displacement fluid connected at a cutting head can also be used, in conjunction with programmed operation of a flow circuit valve and pump, to flush abrasive mixture from a flow circuit.

In the following, different aspects of the present invention will be outlined together with potential combinations of the different aspects.

In the first aspect there is provided an abrasive suspension feed arrangement to a cutting head of an abrasive waterjet apparatus in which cutting head a high velocity waterjet entrains abrasive suspension into a focus tube and discharges a cutting jet at the focus tube outlet said abrasive suspension feed arrangement consists of a source of abrasive suspension at a point a conduit with its inlet end connected at the point to the source of abrasive suspension and connected at its outlet end to a cutting head an abrasive suspension on/off valve in said conduit a source of displacement fluid at the cutting head characterised by:

a) the pressure at the point where the inlet end of the first conduit connects to the source of abrasive suspension is below the pressure at the source of displacement fluid b) when the abrasive suspension on/off valve in said conduit is open and a high velocity waterjet is present in the cutting head abrasive suspension flows from the source of abrasive suspension at the point through the conduit to the cutting head c) when the abrasive suspension on/of valve in the conduit is open and there is no high velocity waterjet in a cutting head abrasive suspension is displaced from said conduit towards its inlet end at the point by fluid from the source of displacement fluid at the cutting head.

In the second aspect abrasive suspension is in motion local to the point where said first conduit connects to the source of abrasive suspension.

In the third aspect the motion of the abrasive suspension local to the point in aspect 2 is caused by abrasive suspension flowing in a second conduit to which the first conduit is connected at the point.

In the fourth aspect the motion of the abrasive suspension local to the point in aspect 2 is caused by an agitator in a vessel in which vessel the inlet to conduit 1 is connected at the point.

In the fifth aspect there is provided an abrasive suspension feed arrangement of the first aspect with an actuator for said abrasive suspension on/off valve that is controlled by a control system of an abrasive waterjet apparatus to a) start and stop abrasive suspension flow to a cutting head when there is a high velocity waterjet present in a cutting head b) cause the abrasive suspension on/off valve to open for displacement fluid to enter conduit 1 at a cutting head to flow towards the source point of abrasive suspension to clear abrasive suspension from part or all of the first conduit when there is no high velocity waterjet in a cutting head.

In the six aspect the control system of the fifth aspect is programmed to open the abrasive suspension on/off valve of the first aspect for a period of time to allow abrasive suspension to be displaced from the first conduit before the rheological properties of the abrasive suspension change such that after a period of stagnant flow in the conduit a flow blockage could form in the conduit or cutting head when a waterjet is subsequently present in a cutting head and an abrasive suspension valve on/off valve is open.

In the seventh aspect there is provided an abrasive feed arrangement as in the first aspect in which the source of displacement fluid is ambient fluid at a focus tube outlet.

In the eighth aspect there is provided an abrasive feed arrangement as in the first aspect in which a valved source of displacement fluid is connected to a cutting head via a valved connection such that when there is no waterjet present in the cutting head opening the source of displacement fluid valve and opening the abrasive suspension on/off valve in the first conduit causes abrasive suspension to be displaced from the conduit towards the source point of abrasive suspension.

In the ninth aspect there is provided an abrasive feed arrangement as in the first aspect in which a source of displacement fluid is connected to a cutting head via a valved connection such that when there is a waterjet present in the cutting head opening the valve to the source of displacement fluid causes displacement fluid to flow to a cutting head to be entrained by the waterjet.

In the tenth aspect there is provided an abrasive suspension feed arrangement to an entrainment chamber of a cutting head of the first aspect that forms part of an abrasive waterjet apparatus, in said cutting head a high velocity waterjet traverses a chamber entraining abrasive suspension from the abrasive suspension feed system into the chamber and on into a focus tube to produce an abrasive cutting jet at the cutting head outlet, said abrasive suspension feed arrangement consists of a source of abrasive suspension a conduit with its inlet end connected at a point to said source of abrasive suspension and its outlet end to a cutting head entrainment chamber an abrasive suspension on/off valve in said conduit a source of displacement fluid from the ambient environment at a focus tube outlet or a valved source of displacement fluid connected to an entrainment chamber or a valved source of displacement fluid connected to said first conduit between the abrasive suspension on/off valve and a cutting head entrainment chamber, characterised by:

d) a pressure below atmospheric pressure at the point where the conduit connects to the source of abrasive suspension e) when the abrasive suspension valve in first conduit is open and a high velocity waterjet is present in a cutting head, and if a valved source of displacement fluid is present the displacement fluid valve is closed, abrasive suspension flows from the source of abrasive suspension at the point through the conduit to the cutting head entrainment chamber f) when an abrasive suspension on/of valve in the conduit is open, and there is no high velocity waterjet in a cutting head, abrasive suspension is displaced from an entrainment chamber and conduit by displacement fluid that:

i) enters a focus tube outlet from ambient at the focus tube outlet and flows via a focus tube, entrainment chamber and conduit towards the abrasive suspension source at the point or ii) enters an entrainment chamber via a an open fluid displacement valve and flows via the conduit towards the abrasive suspension source at the point and via a focus tube to the environment or iii) flows via an open fluid displacement valve to a junction located in conduit between the abrasive suspension on/off valve and the cutting head entrainment chamber and flows in conduit toward the source of abrasive suspension at the point and towards the entrainment chamber and via a focus tube to the environment.

g) displacement fluid is entrained into a high velocity waterjet when a displacement fluid valve is open and the abrasive suspension on/off valve is open and the pressure of displacement fluid is at or above the pressure at the source point of abrasive suspension.

In the eleventh aspect there is provided an abrasive suspension feed arrangement to an entrainment cutting head as in the first aspect in which the source point of abrasive suspension is at a junction point between the first conduit of the first aspect and a second conduit in which second conduit 2 the rate of flow of abrasive suspension is substantially greater than the flow rate required to flow from the junction point through the first conduit to the cutting head.

In the twelfth aspect the second conduit of the eleventh aspect form a flow circuit connected at its inlet and outlet ends to an abrasive suspension hopper and which flow circuit there is a junction point to the first conduit of aspect 1 and a pump that causes abrasive suspension to flow in said first conduit.

In the thirteenth aspect the abrasive suspension flow circuit of the twelfth aspect includes a pump in the second conduit downstream of the junction point with the first conduit.

In the fourteenth aspect the abrasive suspension flow circuit of the twelfth aspect includes a variable restriction in the second conduit that is located upstream of the junction point to the first conduit.

In the fifteenth aspect variable restriction of the fourteenth aspect is preferably provided by an actuator that acts on flexible tubing to cause a pressure drop to lower the pressure at the junction point of the first and second conduits.

In the sixteenth aspect the pump of the thirteenth aspect is preferably a peristaltic pump with a variable speed drive.

In the seventeenth aspect a pressure sensing device monitors the pressure in the second conduit of the eleventh aspect close to the junction with the first conduit point to provide a signal to a control system of an abrasive waterjet apparatus that acts to set the variable pressure reducing restriction of the fifteenth aspect and the speed of the pump of the thirteenth aspect to control the pressure at the junction point between the first and second conduits.

In the eighteenth aspect an abrasive suspension circulation circuit of the twelfth aspect includes an agitated abrasive suspension hopper as part of the flow circuit.

In the nineteenth aspect the agitated abrasive suspension vessel of the eighteenth aspect consist of a) a hopper b) an agitator c) an inlet to a flow circuit d) a return from a flow circuit e) a bed of abrasive particles f) water cover above the bed of abrasive particles characterised by a) a hopper with dimensions that enables an agitated bed of abrasive particles to be maintained with a depth of water cover above the bed such that the cover water surface is essentially quiescent b) The inlet connection to a flow circuit positioned at a location in the agitated abrasive bed where the abrasive concentration is that required at a cutting head.

In the twentieth aspect water is fed into an abrasive suspension vessel of the twelfth aspect either directly or into the second conduit of the eleventh aspect downstream of the point where the first and second conduits meet and upstream of the pump of the thirteen aspect.

In the twenty first aspect the hopper of the nineteenth aspect has an overflow

In the twenty second aspect the hopper of the nineteenth aspect is mounted on a weight sensor to allow monitoring of the amount of abrasive in a hopper.

In the twenty third aspect means are provided to move an agitator of the nineteenth aspect between a location in the abrasive bed and a location in the cover water.

In the twenty fourth aspect means are provided to move an inlet to a flow circuit of the twelfth aspect between a location in the abrasive bed and a location in the cover water.

In the twenty fifth aspect a source of dry abrasive particles is provided above the surface of the water surface of the hopper of the nineteenth aspect.

In the twenty sixth aspect a control system is provided that uses the signal from the weight sensor of the twenty second aspect to cause abrasive particles from the source of abrasive particles of the twenty fifth aspect to be discharged onto the surface water of the hopper of the nineteenth aspect.

In the twenty seventh aspect the agitator of the nineteenth aspect is driven by a variable speed motor and provide a signal of the torque on the agitator.

In the twenty eighth aspect a control system is provided and programmed that automatically can start up an abrasive feed system by a) with the inlet to a flow circuit of the nineteenth aspect positioned in the cover water start up the pump of the thirteenth aspect b) with the agitator of the nineteenth aspect positioned in the cover water start up the agitator c) reposition the inlet to the flow circuit and the agitator into the abrasive bed in the hopper at a rate determined by limiting the torque on the agitator to a set value or limiting load changes on weight sensor of the fifteenth aspect to pre-determined values.

In the twenty ninth aspect a control system is provided and programmed that automatically shuts down an abrasive feed system in such a manner as to be able to automatically re-start an abrasive feed system the shutting down procedure involving a) stopping agitation b) re-positioning the agitator and the inlet to the flow circuit into the cover water c) opening the abrasive suspension on/off valve of the first aspect to clear abrasive from the conduit of the first aspect followed by closing of the suspension on/off valve d) after a sufficient time period to clear abrasive from the flow circuit stopping the pump of the thirteenth aspect.

In the thirtieth aspect abrasive suspension may contain additives that modify its rheological properties.

BRIEF DESCRIPTION OF THE DRAWINGS

Further features and advantages of the invention will now be described with reference to the enclosed figures, where.

DETAILED DESCRIPTION OF THE DRAWINGS

Figure 1:
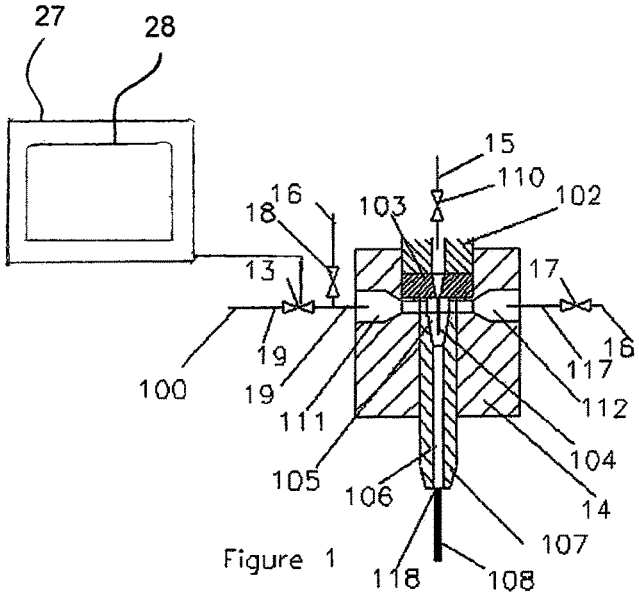
FIG. 1 shows an entrainment cutting head.

Referring first to FIG. 1 that shows a cutting head 14 that generates a cutting jet 108. Pressurised water from a source 15 flows via pressurised water shut off valve 110 and collimation tube 102 to a waterjet nozzle 103 to produce a high velocity waterjet 104. The waterjet 104 traverses an entrainment chamber 105 and enters the bore 106 of a focus tube 107. In traversing entrainment chamber 105 the waterjet 104 entrains abrasive suspension from source 100 through conduit 19, with abrasive suspension on/off valve 13 to passageway 111 and into entrainment chamber 105 and focus tube bore 106. In focus tube bore 106 momentum is exchanged between the waterjet 104 and abrasive particles and water in abrasive suspension to generate the cutting jet 108 at a focus tube outlet 118.

A source of displacement fluid 16 at above atmospheric pressure may be provided through valve 17, tubing 117 and passageway 112 to entrainment chamber 105 or a source of displacement fluid 16 may be provided through valve 18 to conduit 19 between abrasive suspension on/off valve 13 and cutting head passageway 111. The displacement fluid will usually be water although in some circumstances pressurised air may be preferable.

To cut effectively with cutting heads described in EP 2 097 223 B1 and WO 2011/070154 A1 the pressure of abrasive suspension from source 100 needs to be at a pressure below atmospheric to achieve desired abrasive concentrations in cutting jet 108. If pressurised water shut off valve 110 is closed and abrasive suspension on/off valve 13 is open and if separate source of displacement fluid 16 is not provided or valves 17 and 18 (FIG. 1) are closed, ambient fluid 26 (FIG. 6) at 118 is drawn in focus tube bore 106. The ambient fluid drawn in at 118 is air unless focus tube 107 is submerged when water is drawn in. The fluid drawn into focus tube bore 106 flows through entrainment chamber 105, passageway 111 and conduit 19 towards the abrasive suspension source 100.

With pressurised water shut off valve 110 closed and abrasive suspension on/off valve 13 open and either valve 17 or 18 open displacement fluid from source 16 flows towards the abrasive suspension source 100. In the case of pressurised displacement fluid flowing through valve 17 it passes through tubing 117, passageway 112, entrainment chamber 105, passageway 111, and conduit 19 with abrasive suspension on/off valve 13 displacing abrasive suspension towards the source of abrasive suspension 100. In passing through entrainment chamber 105 part of the displacement fluid also flows through focus tube bore 106 to discharge at focus tube outlet 118. When displacement fluid from a source 16 enters through valve 18 to conduit 19 it flows towards the source of abrasive suspension 100 through valve 13 and also towards the focus tube outlet 118 through passageway 111, entrainment chamber 105 and focus tube bore 106.

With pressurised water shut off valve 110 and abrasive suspension shut off valve 13 open, and if either a valve 17 or 18 is open to a source of displacement fluid 16 at a pressure above that of the source of abrasive suspension 100, displacement fluid from source 16 is entrained by a waterjet 104. Displacement fluid also flows towards the abrasive suspension source 100.

With pressurised water shut off valve 110 open and abrasive suspension shut off valve 13 closed and a displacement fluid valve 17 or 18 open the flow of displacement water from a source 16 may be varied so as to change the characteristics of the waterjet at the focus tube 107 outlet 118. The amount of water flowing from source 16 can increase or decrease the intensity of cavitation on a workpiece close to the focus tube 107 outlet 118. The ability to vary cavitation intensity can be useful in marking and etching workpiece surfaces.

When an abrasive waterjet 104 is entraining abrasive suspension the concentration of abrasive in cutting jet 108 can be reduced by metering displacement water from source 16 through valve 17 or 18. In the case of displacement water metered through valve 17 rapid changes in abrasive concentration in cutting jet 108 are possible to provide control of material removal during etching and milling.

Figure 2:
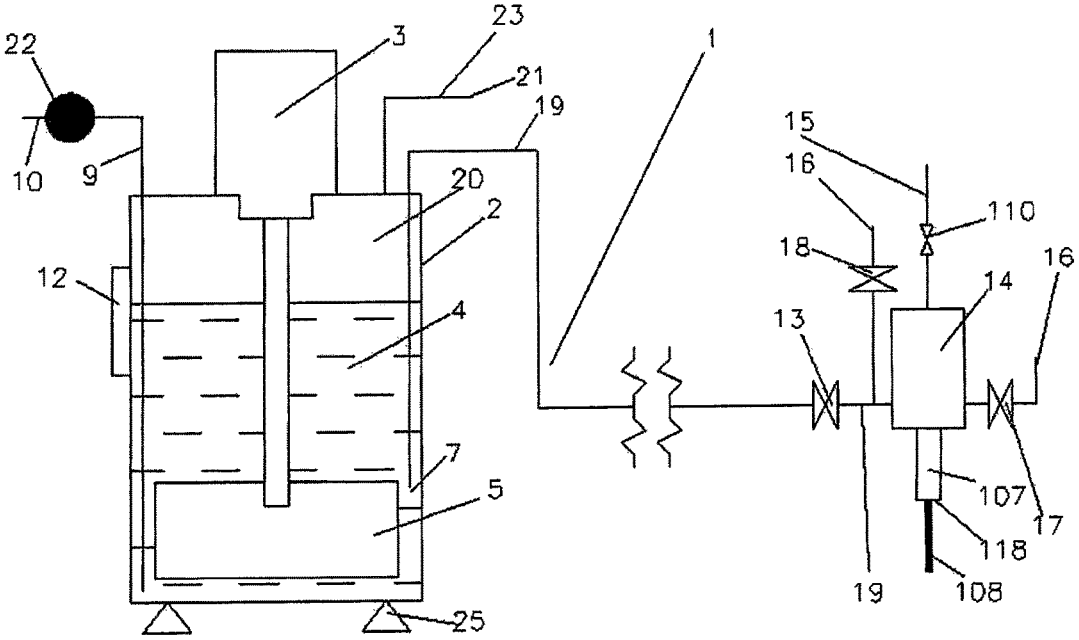
FIGS. 2 and 3 show abrasive suspension feed systems for a cutting head.

Referring now to FIG. 2 that shows an abrasive suspension feed circuit 1 for an entrainment cutting head 14. Hopper 2 has an agitator 3 with stirrer 5 and is partially filled with abrasive/water mixture 4 with an abrasive content of typically 60 to 70 wt %. Hopper 2 is topped up with abrasive suspension from source 10 through pump 22 and conduit 9. A pump 22, which will usually be a reversible peristaltic pump, transfers abrasive suspension 4 into and out of hopper 2 through conduit 9. Hopper 2 is sealed from the environment and air space 20 is connected via conduit 23 to a vacuum source 21.

Abrasive suspension 4 enters conduit 19 with abrasive suspension on/off valve 13 at point 7. With valve 110 open to pressurised water source 15, and valve 13 open a waterjet 104 in cutting head 14 entrains abrasive suspension from hopper 2 at 7 via conduit 19 to entrainment chamber 104 of cutting head 14. The rate of abrasive suspension flow is dependent on the abrasive suspension rheological properties at point 7, on the pressure loss characteristics of the flow line between point 7 and entrainment chamber 104 and on the pressure differential between point 7 and entrainment chamber 104. The pressure at point 7 is controlled by the vacuum source 21. Thus, in this exemplary embodiment, point 7 may be regarded as a source of abrasive suspension which may be arranged in fluid communication with the cutting head 14 via the conduit 19.

A source of displacement fluid 16 may be connected via valve 17 to entrainment chamber 105 of cutting head 14 or connected via valve 18 to conduit 19.

With pressurised water valve 110 closed conduit 19 can be essentially emptied of abrasive suspension when abrasive suspension shut off valve 13 is open and valve 18 or 17 are open to a source of displacement fluid 16 at a pressure above atmospheric pressure. Part of the displacement fluid also flows through focus tube 107.

When a source of displacement fluid 16 is not provided or valve 17 or 18 if present are closed, displacement fluid from the environment at focus tube 107 outlet 118 enters a focus tube when valve 110 is closed and valve 13 open and there is a vacuum in space 20 in hopper 2. The displacement fluid is air unless a focus tube 107 outlet is submerged in water when the displacement fluid is water. The displacement fluid flows through conduit 19 to discharge into hopper 2 at point 7.

Displacement air entering hopper 2 at point 7 bubbles up through abrasive suspension 4 and is exhausted through conduit 23. To limit the amount of air that vacuum source 21 has to pump valve 13 is desirably scheduled to be open for a time just sufficient to allow abrasive suspension to be cleared from conduit 19. In order to avoid changing the abrasive concentration in abrasive suspension 4 in vessel 2 when the displacement fluid is water, valve 13 is desirably scheduled to be open for a time just sufficient for displacement water to clear abrasive suspension from conduit 19.

Valve 13 may be located at point 7 to conduit 19 to avoid programming periodic opening and closing of valve 13 to flush migrating and dewatering abrasive that enters conduit 19 at point 7 after initial clearing of abrasive suspension from conduit 19.

Depending on abrasive suspension characteristics and the addition of additives, abrasive suspension 4 in hopper 2 may be maintained in a suitable condition without agitator 3 and stirrer 5. Instead it can be arranged that abrasive suspension 4 is cyclically pumped into and out of hopper 2 by pump 22, whilst maintaining sufficient abrasive suspension 4 in hopper 2 to supply abrasive suspension 4 to cutting head 14.

Figure 3:
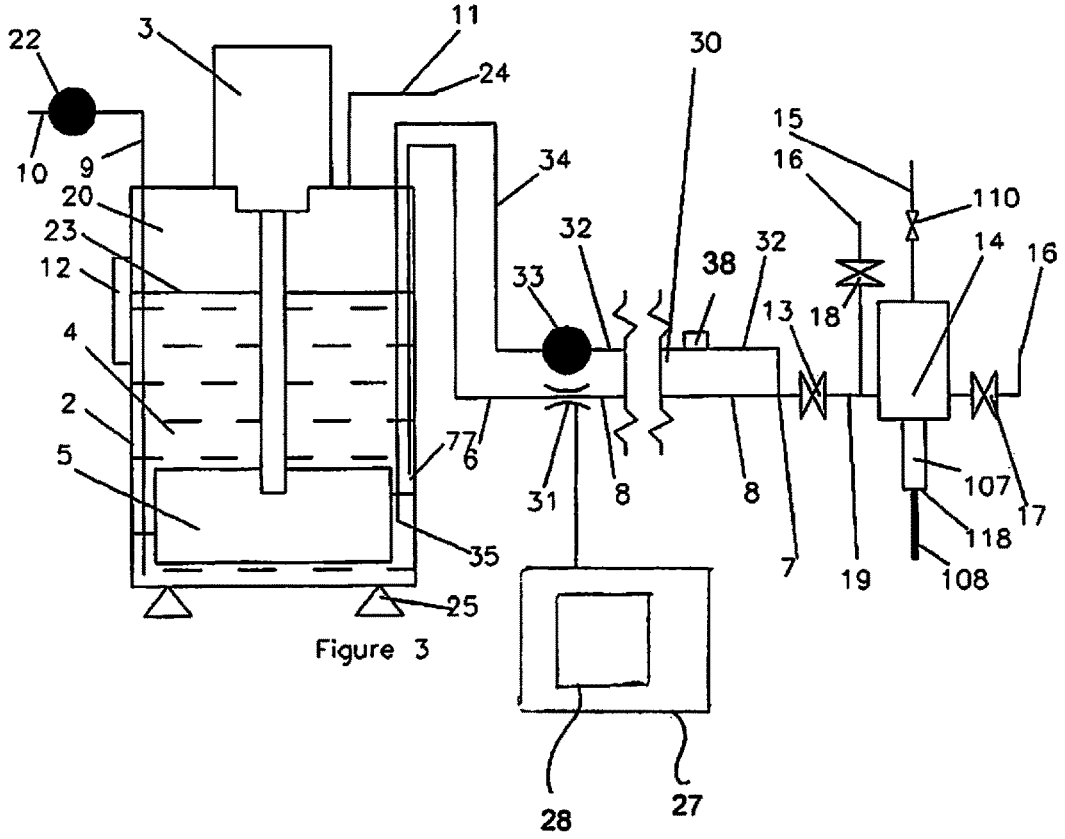

Referring now to FIG. 3 that shows an abrasive suspension feed system 30 in which substantially more abrasive suspension is pumped in a flow circuit passing close to a cutting head 14 than is required by a cutting head. The flow circuit is formed by conduit 6 with inlet 77 and variable flow restriction 31, conduit 8, a junction at point 7, conduit 32, pump 33 and conduit 34 with outlet 35 from the flow circuit in hopper 2. In this exemplary embodiment, junction point 7 may be regarded as a source of abrasive suspension which may be arranged in fluid communication with the cutting head 14 via conduit 19.

The flow direction in the flow circuit may be reversed so that the pressure at junction 7 can be above or below the pressure acting on the surface 23 in hopper 2. Reversal of flow direction may be necessary if a blockage occurs in the flow circuit.

The pressure at junction point 7 is controlled by varying the speed of pump 33, by the setting of restriction 31, by the abrasive suspension surface level 23 in hopper 2 relative to cutting head 14 and by the pressure in air space 20 acting on surface 23. The pressure in air space 20 is the air source pressure 24 connected through conduit 11 and is preferably atmospheric pressure.

A pressure sensor 38 located close to junction point 7 provides a signal for setting the pressure at junction point 7.

Operation of hopper 2 of FIG. 3 is generally as for hopper 2 of FIG. 2 as is the function of valves 13, 17 and 18.

Figure 4:
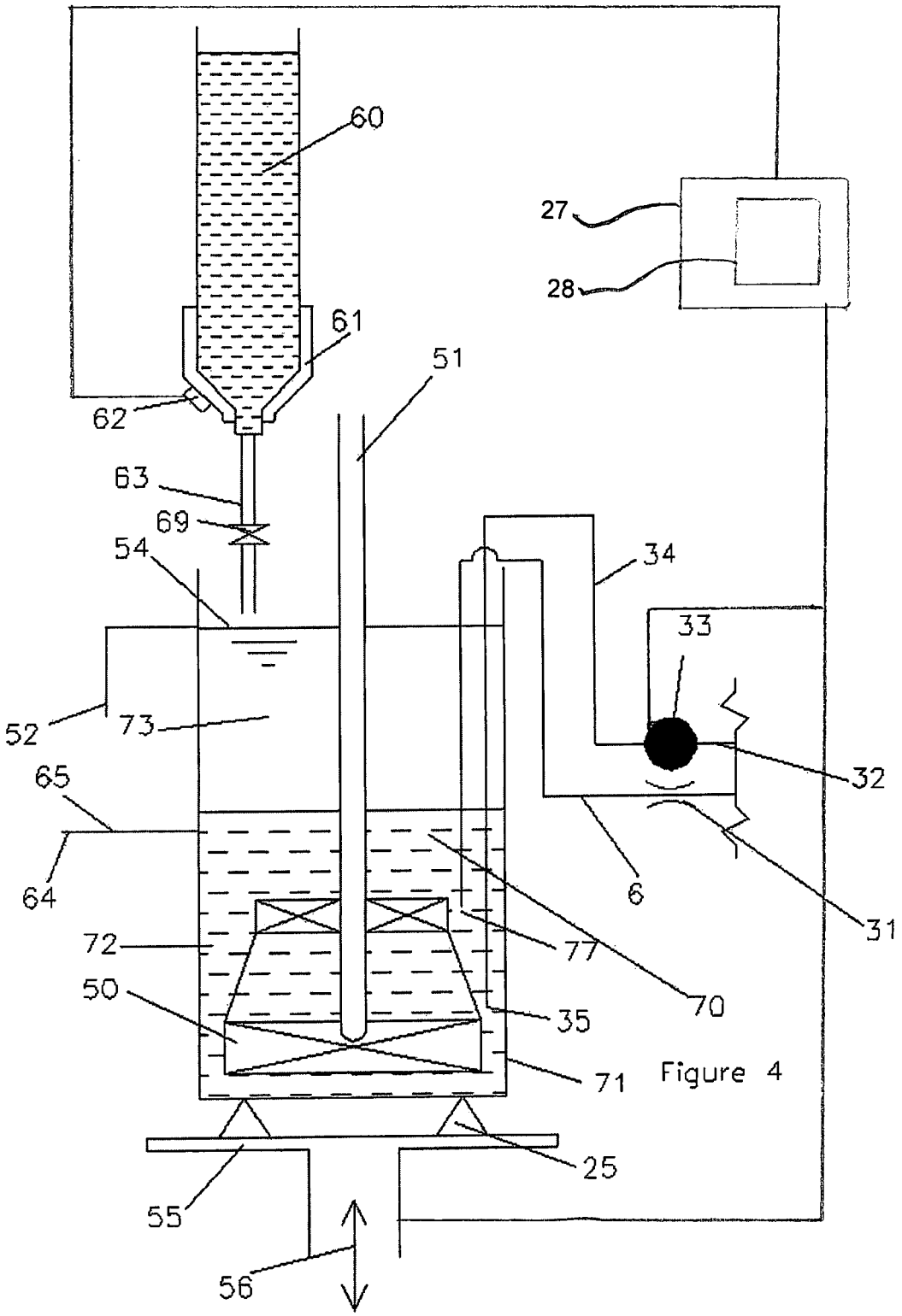
FIG. 4 shows an abrasive suspension hopper.
Figure 5:
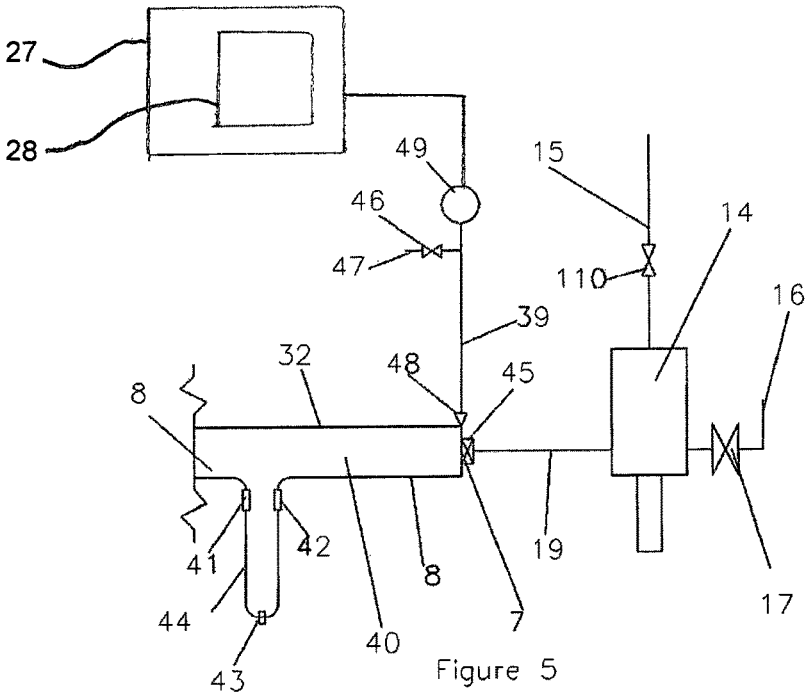
FIG. 5 shows part of an abrasive suspension feed system.

Referring now to FIG. 4 that shows part of an abrasive suspension feed system 70 that with part of an abrasive suspension feed system 40 of FIG. 5 forms a complete abrasive suspension feed system.

FIG. 4 shows that a layer of cover water 73 is provided above a suspended abrasive bed 72. An agitator 51 with impeller 50 is adapted to stir the bed 72. A weight sensor 55 comprising a load cell 25 is mounted to the hopper 71, and is vertically movable (double arrow 56) depending on the change of load. The vertical movement may be used as an output to a control system 27 for adding dry abrasive powder particles, or controlling the rate at which the impeller 50 is lowered into the bed 72 during start up.

Dry abrasive powder particles are contained in a silo 60 which is mounted in a holder 61. When powder is to be discharged, a valve 69 in a discharge pipe 63 is opened and a vibrator 62 is actuated to provide vibrations to the holder 61, whereby the powder particles fall down to the surface 54 of the cover water 73 and descend in a density current to the agitated abrasive bed 72 with little mixing with the cover water 73. Water from a water source 64 through connection 65 may be bled into the abrasive bed 72 at a controlled rate and appropriate location to help maintain the desired abrasive concentration at inlet 77 where abrasive suspension is withdrawn from the bed 72.

FIG. 4 also shows an overflow 52 at the top portion of the hopper 71. Excess water flowing up through the bed 72 over flows at the cover water surface 54 to maintain a set water level allowing continuous calculation of the weight of abrasive in the hopper 71 and to carry away material in the abrasive feed that does not wet and floats on the cover water surface 54.

Referring now to FIG. 5 that shows part of abrasive suspension feed system 30 of FIG. 3 but with additional features that makes it particularly suitable for use with the abrasive suspension hopper 71 of FIG. 4.

To prevent abrasive accumulating and dewatering at junction point 7 when there is no flow through conduit 19 to cutting head 14, abrasive suspension valve 13 of FIG. 3 is replaced by valve 45 located at junction point 7.

When the hopper 71 of FIG. 4 is operating it requires a flow of topping up water to maintain the cover water level 54. Topping up water beneficially flows into conduit 32 to reduce the abrasive concentration at entry to pump 33.

Direct measurement of abrasive suspension vacuum pressures that can fall below 400 mm Hg is difficult because abrasive accumulates in connections to and the space within a pressure gauge or pressure transducer. By measuring the pressure of topping up water entering conduit 32 the pressure at junction point 7 can be inferred without abrasive suspension being in direct contact with a pressure transducer. Topping up water from source 47 flows through valve 46, conduit 39 to a non-return valve 48 that prevents abrasive suspension entering conduit 39 from conduit 32. Non-return valve 48 may be of a duckbill or similar valve made of polymeric material with a low pressure drop. Pressure sensor 49 measures the pressure in conduit 39, which is essentially the pressure at junction point 7 that controls the flow of abrasive suspension to cutting head 14 and provides a signal indicative of the pressure to the control unit 28.

To provide a measure of abrasive concentration the weight of abrasive suspension in a section of conduit 44 can be determined. Conduit 44 is attached by flexible joints 41 and 42 to conduit 8. A load cell 43 is used to determine the change in weight between water flow through conduit 44 and abrasive suspension flow allowing a calculation of suspension density.

Although in FIGS. 3-5 one cutting head 14 is connected to flow circuit 8, 32 between restrictor 31 and pump 33 two or more cutting heads of an abrasive waterjet cutting apparatus could be connected to flow circuit 8, 32.

Figure 6:
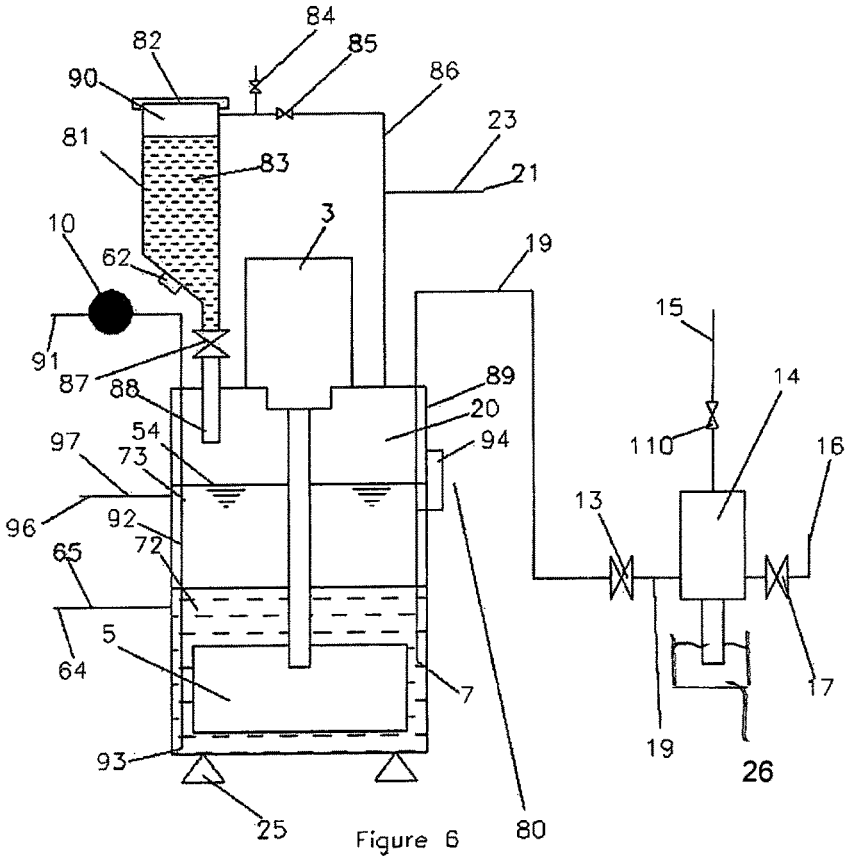
FIG. 6 shows an abrasive suspension feed system.

Referring to FIG. 6 that shows a suspension feed system 80 that has features of feed system 1 of FIG. 1 and of hopper 71 of FIG. 4. A dry abrasive powder silo 81 is connected to hopper 89 to allow topping up of hopper 89 with dry abrasive powder 83 in a manner similar to topping up hopper 71 of FIG. 4 but with a vacuum in air space 20 above the cover water 73. Silo 81 has sealable lid 82 to allow filling up silo 81 with abrasive powder 83. Conduit 86 with isolation valve 85 allow pressures in air space 90 in silo 81 to be equalised with the pressure in airspace 20 in hopper 89 provided by vacuum source 21 through conduit 23. Powder valve 87 is opened when pressures in air spaces 20 and 90 are equalised. With powder valve 87 open actuation of vibrator 62 cause abrasive powder 83 to flow from silo 81 through connection 88 and fall onto cover water 73 surface 54.

With valves 85 and 87 closed and valve 84 open the pressure across sealable lid 82 is equalised and the lid 82 can be opened to top up silo 81 with abrasive powder 83.

When rotation of stirrer 5 is to be stopped for a time period sufficiently long that abrasive bed 72 could settle the majority of the bed 72 may be removed through conduit 92 with inlet at 93 by pump 10 to storage source 91. Alternatively an additive that prevents firm settling of abrasive particles may be introduced into bed 72 from source 91 or by other means to allow stirrer 5 to start rotation in a settled bed 72 without excessive torque.

A signal from level sensor 94 along with the output from load cell 25 can be used to maintain the cover water level 54 from water source 96 through connection 97 and to control topping up abrasive bed 72 with abrasive from silo 81.

An abrasive waterjet apparatus for machining forms part of a machine tool. The machine tool is required to be highly automated and this includes the abrasive feed system. Except for the filling of a bulk hopper with dry abrasive powder all abrasive suspension feed system functions need to be automated and controlled by the machine tool control system through the control system of the abrasive waterjet apparatus. Automation extends from initiating start up actions that make abrasive suspension of a specified concentration available close to a cutting head to the shutting down of a feed system for an extended period in such a manner as to allow automated start-up of the system at a later date. The preferred abrasive suspension feed system embodiment of this invention, shown in FIGS. 4 and 5, is particularly suited to automated operation.

The exception to full automation is loss of electrical power for a period sufficiently long that troublesome settling of abrasive particles occurs when manual intervention is required using a source of pressurised water or compressed air to clear abrasive suspension for tubing and passageways to prevent blockages on restarting a feed system. Abrasive feed system tubing is arranged to have quick connect and disconnect connections including the tubing for the peristaltic pump to allow easy access to flush abrasive suspension from a flow circuit following loss of power.

The invention claimed is:

1. An abrasive jet system for producing an abrasive cutting jet, the abrasive jet system comprising a cutting head having at least two connections and adapted to receive pressurised water at a first connection of the cutting head to generate a high velocity waterjet, a source of abrasive suspension, a conduit, at a second connection of the cutting head, for providing the source of abrasive suspension in fluid communication with the cutting head, an abrasive suspension on/off valve provided in said conduit and having an open state and a closed state, a source of displacement fluid in fluid communication with a portion of said conduit located between the cutting head and the abrasive suspension on/off valve, wherein the pressure at said source of abrasive suspension is controllable to be below the pressure at said source of displacement fluid, wherein when said abrasive suspension on/off valve is open and said high velocity waterjet is present in the cutting head, the abrasive suspension flows via said conduit into the cutting head and is entrained by the high velocity waterjet in the cutting head to produce an abrasive cutting jet, and wherein when the cutting head is void of high velocity waterjet and said pressure at the source of abrasive suspension is below the pressure at said source of displacement fluid, and said abrasive suspension on/off valve is opened, flow of abrasive suspension present in the conduit is reversed.

2. The abrasive jet system as claimed in claim 1, wherein said pressure at said source of abrasive suspension is a subatmospheric pressure.

3. The abrasive jet system of claim 1, further comprising a control system configured to control the opening and closing of said abrasive suspension on/off valve, wherein when said abrasive suspension on/off valve is closed, and the cutting head is void of high velocity waterjet, the control system is adapted to, within a time period, open said abrasive suspension on/off valve to allow displacement fluid to displace abrasive suspension present in the conduit towards said source of abrasive suspension.

4. The abrasive jet system of claim 1, further comprising a hopper containing a bed of abrasive particles which, in operation of the abrasive jet system, is suspended, and a flow circuit having an inlet end and an outlet end which are in fluid communication with said hopper, wherein said conduit is connected to said flow circuit at a junction point, wherein said junction point represents said source of abrasive suspension.

5. The abrasive jet system of claim 4, further comprising
a control unit configured to control the pressure at said junction point, and
a pressure sensing device adapted to monitor the pressure in the flow circuit in the vicinity of said junction point to provide a signal indicative of said pressure to the control unit.

6. The abrasive jet system of claim 5, further comprising
a pump in the flow circuit downstream of said junction point, wherein the pressure at the junction point is controlled by controlling the flow through the pump.

7. The abrasive jet system as claimed in claim 6, wherein said pump is in the form of a peristaltic pump with variable speed drive, wherein the pressure at the junction point is controlled by controlling the speed of the pump.

8. The abrasive jet system of claim 6, wherein said control unit is operatively connected to the pump and adapted to control the speed of a fluid flow through the pump based on said signal from the pressure sensing device, thereby controlling the pressure at said junction point.

9. The abrasive jet system of claim 6, wherein said hopper includes cover water above the bed of abrasive particles, the abrasive jet system further comprising
a control system, and
an agitator for agitating said bed of abrasive particles, the agitator being controlled by the control system,
wherein the dimensions of said hopper is such that the agitated bed of abrasive particles are maintained with a depth of cover water above the bed such that the cover water surface is quiescent.

10. The abrasive jet system of claim 9, wherein the inlet end of the flow circuit is positioned at or positionable to a location in the agitated bed of abrasive particles where the abrasive concentration is that required at the cutting head.

11. The abrasive jet system of claim 9, wherein water is fed into said hopper either directly or into the flow circuit downstream of said junction point.

12. The abrasive jet system of claim 9, wherein said hopper is provided with an overflow pipe.

13. The abrasive jet system of claim 9, wherein said hopper is mounted on a weight sensor for determining the amount of abrasive in said hopper.

14. The abrasive jet system of claim 13, wherein a source of dry abrasive particles is provided above the surface of the cover water.

15. The abrasive jet system of claim 14, wherein said control system is operatively connected to the weight sensor and the source of dry abrasive particles in order to control the discharging of dry abrasive particles from said source of dry abrasive particles onto the surface of the cover water based on an input signal from the weight sensor.

16. The abrasive jet system of claim 13, wherein said agitator is driven by a variable speed motor and provides a signal of the torque on the agitator.

17. The abrasive jet system of claim 16, wherein said control system is configured to start up an abrasive feed system
with the agitator positioned in the cover water starting up the agitator,
measuring the torque on the agitator, and
repositioning the agitator into the abrasive bed in the hopper at such a rate that a predetermined load change on the weight sensor is not exceeded.

18. The abrasive jet system of claim 16, wherein said control system is configured to shut down an abrasive feed system in such a manner as to be able to automatically re-start the abrasive feed system, wherein when shutting down the abrasive feed system the control system
stops the agitator,
re-positions the agitator and the inlet end of the flow circuit into the cover water,
opens the abrasive suspension on/off valve to clear abrasive from said conduit followed by closing the abrasive suspension on/off valve, and
after a sufficient time period to clear abrasive from the flow circuit stops the pump.

19. The abrasive jet system of claim 9, wherein said agitator is movable between said bed of abrasive particles and said cover water.

20. The abrasive jet system of claim 9, wherein said inlet end of the flow circuit is movable between said bed of abrasive particles and said cover water.

21. The abrasive jet system of claim 9, wherein said control system is configured to start up an abrasive feed system
with the agitator positioned in the cover water start up the agitator,
measuring the torque on the agitator, and
repositioning the agitator into the abrasive bed in the hopper at such a rate that a predetermined torque on the agitator is not exceeded.

22. The abrasive jet system of claim 21, wherein during said start up, said control system is further configured to
with the inlet end of the flow circuit positioned in the cover water start up the pump, and
reposition the inlet end of the flow circuit into the abrasive bed.

23. The abrasive jet system of claim 5, further comprising
a variable restriction in the flow circuit upstream of said junction point, wherein the pressure at the junction point is controlled by controlling the flow through the restriction.

24. The abrasive jet system of claim 23, wherein said variable restriction is in the form of an actuator adapted to act on flexible tubing to cause a pressure drop to lower the pressure at said junction point.

25. The abrasive jet system of claim 23, wherein said control unit is operatively connected to the variable restriction and adapted to vary the restriction based on said signal from the pressure sensing device, thereby controlling the pressure at said junction point.

26. The abrasive jet system of claim 4, wherein a rate of flow in said flow circuit is greater than a rate of flow in said conduit to the cutting head.

27. The abrasive jet system of claim 1, further comprising
a focus tube having an outlet from which said cutting jet is discharged, the focus tube outlet being submerged in ambient fluid, thereby allowing ambient fluid to enter through the focus tube outlet when said cutting jet is not discharged, wherein, when said cutting jet is not discharged, said source of displacement fluid is the ambient fluid entered in the focus tube.

28. The abrasive jet system of claim 1, wherein a valved source of displacement fluid is connected to the cutting head via a valved connection such that
when there is no waterjet present in the cutting head, opening the source of displacement fluid valve and opening the abrasive suspension on/off valve in the conduit causes abrasive suspension to be displaced from the conduit towards the source of abrasive suspension, and when said waterjet is present in the cutting head, opening the source of displacement fluid valve causes displacement fluid to flow to the cutting head to be entrained by the waterjet.

* * * * *